US007256540B2

(12) United States Patent
Jeon et al.

(10) Patent No.: US 7,256,540 B2
(45) Date of Patent: Aug. 14, 2007

(54) ELECTRON EMISSION DEVICE WITH A GRID ELECTRODE

(75) Inventors: Sang-Ho Jeon, Suwon-si (KR); Byong-Gon Lee, Suwon-si (KR)

(73) Assignee: Samsung SDI Co., Ltd, Suwon-si (KR)

( * ) Notice: Subject to any disclaimer, the term of this patent is extended or adjusted under 35 U.S.C. 154(b) by 47 days.

(21) Appl. No.: 10/999,106

(22) Filed: Nov. 29, 2004

(65) Prior Publication Data

US 2006/0033413 A1 Feb. 16, 2006

(30) Foreign Application Priority Data

Nov. 28, 2003 (KR) ..... 10-2003-0085468
Mar. 30, 2004 (KR) ..... 10-2004-0021594

(51) Int. Cl.
*H01J 1/62* (2006.01)
*H01J 63/04* (2006.01)

(52) U.S. Cl. ..... 313/495; 313/497

(58) Field of Classification Search ..... 313/495–497, 313/306–311

See application file for complete search history.

(56) References Cited

U.S. PATENT DOCUMENTS 5,751,109 A * 5/1998 Payne ..... 313/542
5,793,152 A * 8/1998 Tang et al. ..... 313/306
6,359,383 B1 * 3/2002 Chuang et al. ..... 313/496
6,664,721 B1 * 12/2003 Jamison et al. ..... 313/309
2002/0000771 A1 * 1/2002 Ge et al. ..... 313/495
2004/0174109 A1 * 9/2004 Chiou et al. ..... 313/103 R
2004/0227452 A1 * 11/2004 Lee et al. ..... 313/495
2005/0239364 A1 * 10/2005 Yang ..... 445/24

FOREIGN PATENT DOCUMENTS

CN 1202974 12/1998
JP 9-139177 5/1997

OTHER PUBLICATIONS

English abstract for WO 97/15912 corresponding to CN 1202974 listed above.
Patent Abstracts of Japan, Publication No. 09-139177, dated May 27, 1977, in the name of Jong Min Kim.

* cited by examiner

*Primary Examiner*—Mariceli Santiago
*Assistant Examiner*—Anne M Hines
(74) *Attorney, Agent, or Firm*—Christie, Parker & Hale, LLP

(57) ABSTRACT

An electron emission device includes a first substrate and a second substrate facing one another and having a predetermined gap therebetween. An electron emission region for emitting electrons is formed on the first substrate, and an illumination portion for displaying images responsive to the electrons emitted from the electron emission region is formed on the second substrate. A grid electrode is mounted between the first and second substrates and configured to focus the electrons emitted from the electron emission assembly. The grid electrode is provided with a plurality of electron passage openings, of which at least one portion of the interior wall of at least one of the electron passage openings is formed with an inclined plane relative to the first substrate. With the above-structured electron emission device, the grid electrode prevents and/or reduces one or more travel courses of electrons from being varied so that illumination of wrong pixels is prevented and/or reduced and overall color purity is improved.

16 Claims, 7 Drawing Sheets

ELECTRON EMISSION DEVICE WITH A GRID ELECTRODE

CROSS REFERENCE TO RELATED APPLICATION

This application claims priority to and the benefit of both Korean Patent Applications Nos. 10-2003-0085468 and 10-2004-0021594 respectively filed on Nov. 28, 2003 and Mar. 30, 2004 in the Korean Intellectual Property Office, the contents of which are incorporated herein by reference.

BACKGROUND OF THE INVENTION (a) Field of the Invention

The present invention relates to a display device, and in particular, to an electron emission display device having a grid electrode structure thereof which efficiently controls the travel course of electrons emitted from the electron emission source.

(b) Description of the Related Art

Generally, electron emission display devices are display devices that can be classified into two types. A first type uses a hot (or thermoionic) cathode as an electron emission source, and a second type uses a cold cathode as an electron emission source.

Also, in the second type of electron emission display devices, there are a field emission array (FEA) type, a surface conduction emitter (SCE) type, a metal-insulator-metal (MIM) type, a metal-insulator-semiconductor (MIS) type, and a ballistic electron surface emitting (BSE) type.

Although the electron emission display devices are differentiated in their specific structure depending upon the types thereof, they all basically have an electron emission unit placed within a vacuum vessel, and a light emission unit facing the electron emission unit in the vacuum vessel.

In the conventional FEA electron emission display device, as the electrons emitted from the electron emitting units travel toward the phosphor regions, there is a problem that the electrons are dispersed by influence of a driving voltage applied to the gate electrode.

To overcome the problem of electron dispersion, it has recently been proposed to use a grid electrode or a focusing electrode to control the travel course of the electrons emitted from the electron emitting unit.

This grid electrode or focusing electrode is mounted between the first substrate having the electron emitting unit disposed thereon and the second substrate having the phosphor portion disposed thereon. Particularly, the grid electrode is disposed while maintaining a uniform gap with the first substrate, and has a plurality of openings, each of which corresponds to one of the pixel regions formed on the first substrate.

In addition, although most electrons are emitted from edges of the electron emitting source and at predetermined angles toward the second substrate, conventional structure of the grid electrode has not been developed considering this point. As such, many of the electrons are unable to pass through the openings of the grid electrode and instead experience misdirection away from their intended paths.

Also, many electrons either arc toward the first substrate while colliding on the interior wall of the grid electrode, or fail to reach the intended phosphor portion. As a result, picture quality is significantly reduced.

SUMMARY OF THE INVENTION

In one aspect of the present invention, an electron emission device blocks specific paths of electrons so that variance from their intended paths or the illumination of incorrect phosphor portions is prevented or substantially reduced to improve a picture quality.

In an exemplary embodiment of the present invention, an electron emission device includes a first substrate and a second substrate facing one another and having a predetermined gap therebetween. An electron emission region for emitting electrons is formed on the first substrate, and an illumination portion for displaying images responsive to the electrons emitted from the electron emission region is formed on the second substrate. A grid electrode is mounted between the first and second substrates and configured to focus the electrons emitted from the electron emission assembly. The grid electrode is provided with a plurality of electron passage openings. At least one of the electron passage openings has an interior wall. The interior wall has at least one portion formed with an inclined plane relative to the first substrate.

The electron emission region may be made from a carbon-based material such as a carbon nanotube material, a graphite material, a diamond material, a diamond-like carbon material, a C60 (Fullerene) material, and/or a combination thereof.

The electron passage opening may be provided with a larger diameter portion S1 and a smaller diameter portion S2. The larger diameter portion S1 may have a diameter larger than a diameter of the smaller diameter portion S2, and the larger diameter portion S1 may be formed at an upper portion of the at least one electron passage opening toward the second substrate.

The larger diameter portion S1 may have a depth D1. The smaller diameter portion S2 may be extended continuously from the larger diameter portion S1 and may have a depth D2. The depth D1 may be shorter than the depth D2.

The at least one electron passage opening may have a cross-section taken longitudinally along a diameter of the at least one electron passage opening. The cross-section may form into an inclined plane tapered downward toward the first substrate, and the inclined plane may be formed as a curved plane.

The larger diameter portion S1 and another larger diameter portion S3 may be respectively formed at the upper portion and a lower portion of the at least one electron passage opening, and the diameter of the larger diameter portion S1 may be reduced gradually from the upper portion to the lower portion and the diameter of the another larger diameter portion S3 may be increased gradually from the lower portion to the upper portion so that the smaller diameter portion S2 is formed at the center of the electron passage opening.

Meanwhile, a ratio ($\alpha$=S1/S2) of the diameter of the large diameter portion S1 to that of the diameter of the small diameter portion S2 may be within about 1 to 2, and that a ratio of the depth D2 of the diameter of the small diameter portion S2 to a total depth D of the at least one electron passage opening may be below about 0.3.

In one exemplary embodiment of the present invention, the grid electrode may have bridge portions interconnecting the electron passage openings, each bridge portion having a smaller width portion B1 at an upper portion of the electron passage openings toward the second substrate and a larger width portion B2 at a lower portion of the electron passage openings toward the first substrate. Here, it may be that a ratio β=B1/B2 of the smaller width portion B1 to the larger width portion B2 is within about 0.2 to 0.5, and that a ratio B1/D of the smaller width portion B1 to a total depth D of the at least one electron passage opening is above about 0.2.

At least one of the bridge portions may have inclined planes tapered entirely upward toward the second substrate, and may have inclined planes with the same (or identical) slope.

The bridge portion may have inclined planes having at least two slope changes along a depth direction of the at least one bridge portion, and the inclined plane formed at one side surface of the at least one bridge portion may have a smaller slope at the upper portion than that at the lower portion and the inclined plane formed at the other (or another) side surface of the at least one bridge portion may have a larger slope at the upper portion than that at the lower portion.

A ratio As/Bw of a horizontal element As of one of the inclined planes formed at one side of the at least one bridge portion to the total width of the bridge portion Bw of the at least one bridge portion and a ratio Cs/Bw of a horizontal element Cs of another one of the inclined planes formed at the other (or another) side of the at least one bridge portion to the total width Bw of the at least one bridge portion may be each respectively within about 0.3 to 0.7, and that a ratio As/Cs of the horizontal element Cs to the horizontal element As may be within about 0.5 to 1.5.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Exemplary embodiments of the present invention will now be described in detail with reference to the accompanying drawings.

Figure 1:
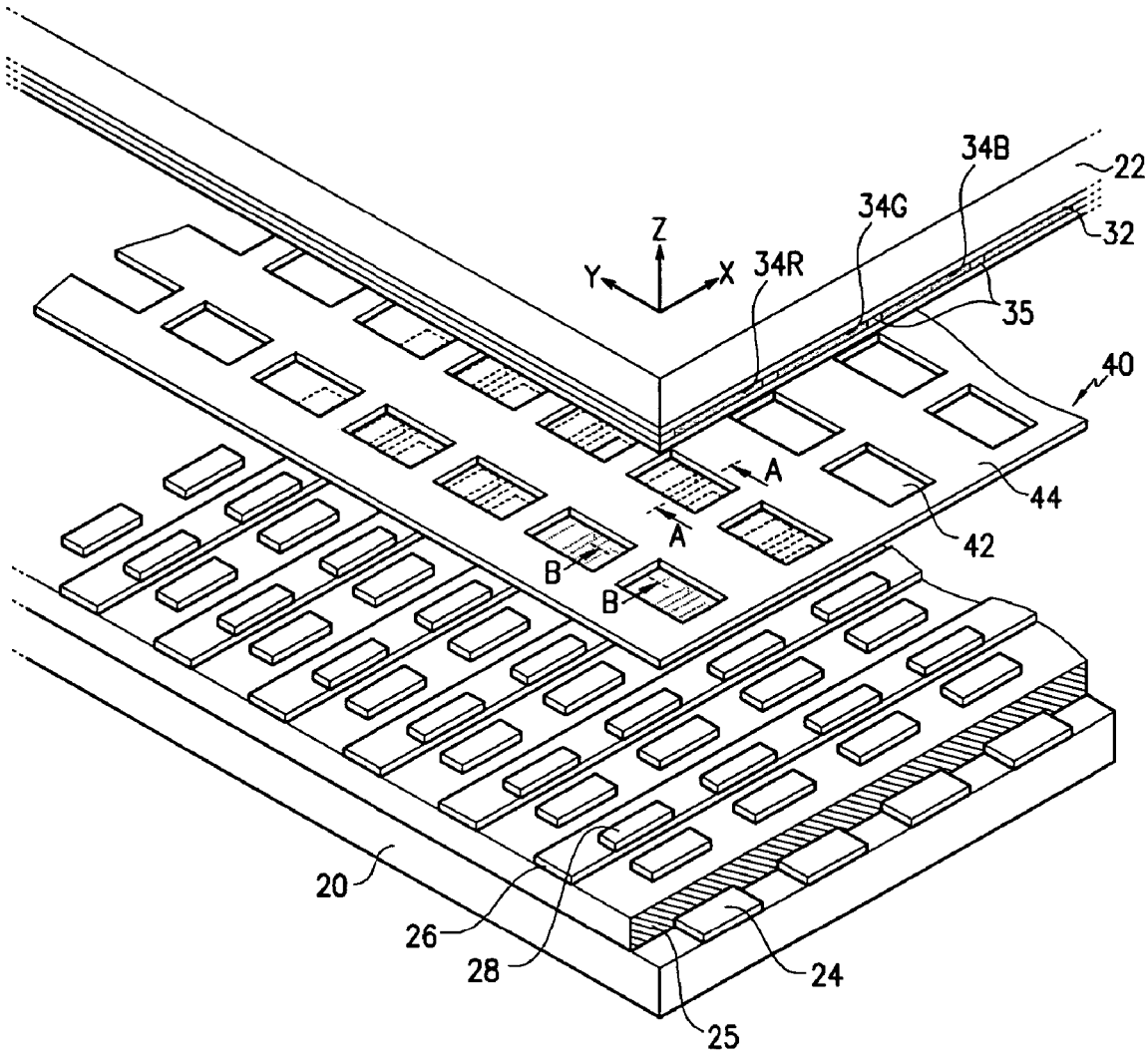
FIG. 1 is a partial exploded perspective view of an electron emission device according to certain exemplary embodiments of the present invention.
Figure 2:
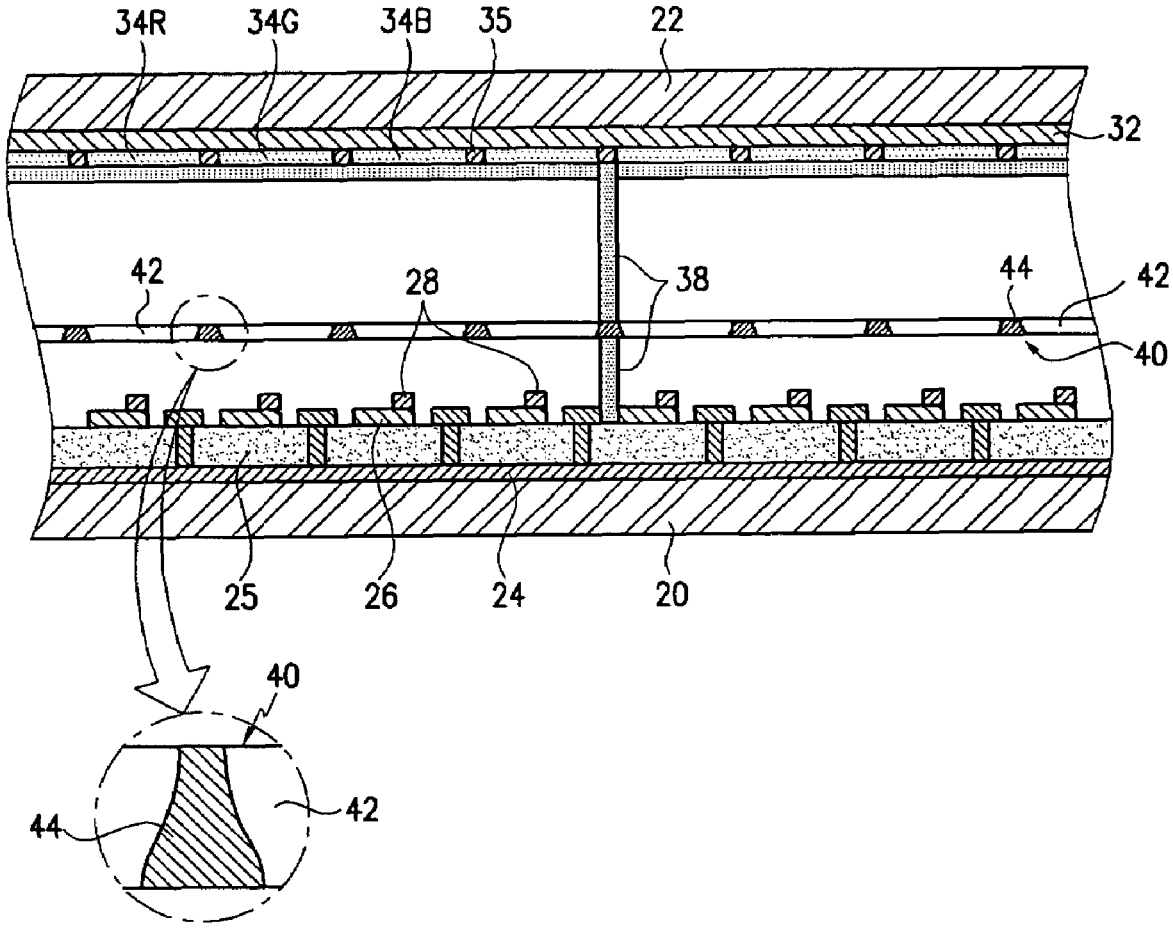
FIG. 2 is a partial exploded cross-sectional view of the electron emission device of FIG. 1 according to the certain exemplary embodiments of the present invention.

FIG. 1 is a partial exploded perspective view of an electron emission device according to certain exemplary embodiments of the present invention, and FIG. 2 is a partial exploded cross-sectional view of the electron emission device of FIG. 1 according to the certain exemplary embodiments of the present invention.

With reference to FIG. 1 and FIG. 2, the electron emission device according to the present invention is constructed as a vacuum vessel by joining a first substrate 20 and a second substrate 22 parallel to one another with a predetermined gap therebetween.

An electron emission unit is formed on the first substrate 20 so as to emit electrons toward the second substrate 22, and an illumination portion is formed on the second substrate 22 so as to display images responsive to the electrons emitted from the electron emission unit.

In more detail, gate electrodes 24, each having an elongated stripe shape, are formed on the first substrate 20 in a stripe pattern along one direction (for example, an X axis direction of the drawings). Further, an insulation layer 25 is formed over an entire surface of the first substrate 20 covering the gate electrodes 24. Cathode electrodes 26, each having an elongated stripe shape, are formed on the insulation layer 25 in a stripe pattern along a direction crossing the direction of (or crossing over) the gate electrodes 24 (for example, a Y axis direction of the drawings).

In the context of the present invention, pixel regions can be referred to as the "intersection" of the gate electrodes 24 and the cathode electrodes 26 (or the crossed regions of the gate electrodes 24 and the cathode electrodes 26).

At least one electron emission region 28 is formed along the length of the cathode electrode 26 corresponding to the location of the pixels. Further, at least one hole (not shown) may be formed through the cathode electrode 26 and the insulating layer 25 to expose the electron emission region 28 on the gate electrode 24 therethrough.

Electron emission materials of the electron emission regions 28 can be formed with one or more carbon-based materials, such as carbon nanotubes, graphite, diamond, diamond-like carbon, and/or C60 (Fullerene). Also, the electron emission regions 28 can be formed with one or more nanometer-sized materials such as carbon nanotubes, graphite nanofibers, and/or silicon nanowires.

Referring now only to FIG. 1, formed on a surface of the second substrate 22 that faces the first substrate 20 is an illumination portion. That is, anode electrodes 32 are formed on the surface of the second substrate 22 and phosphor layers 34R, 34G, and 34B and black layers 35 are formed over the anode electrodes 32. Alternatively, phosphor layers 34R, 34G, and 34B and black layers 35 can be first formed on the surface of the second substrate 22 and then the anode electrodes 32 are formed thereon (not shown).

The anode electrodes 32 may be made from a metal film such as an Al film. The anode electrodes 32 are applied with a voltage necessary to accelerate electrons and act to increase screen brightness by providing a metal back effect, which is known to those skilled in the art.

In addition, the anode electrodes 32 may be made from a transparent conductive film such as indium tin oxide (ITO) or the like. In this case, as shown in FIGS. 1 and 2, the anode electrodes 32 are first formed transparently on the second substrate 22, and phosphor layers 34R, 34G, and 34B and black layers 35 may then be formed over the anode electrodes 32. Further, a metal film is deposited on the phosphor layers 34R, 34G, and 34B and black layers 35 so that it acts to increase screen brightness.

The anode electrodes 32 may be formed over the entirety of the second substrate 22 as a single continuous unit, or formed in a predetermined pattern on the second substrate 22 as a plurality of separate electrodes.

The first substrate 20 and the second substrate 22 structured as described above should be sealed using a sealant such as a frit (not shown) in a state where these two substrates face one another with a predetermined gap therebetween. Then, the air between these two substrates is exhausted to form a vacuum therebetween, thereby completing the electron emission device.

In operation and with the above-structured electron emission device of FIGS. 1 and 2, when a predetermined drive voltage is applied to the gate electrodes 24 and the cathode electrodes 26, an electric field is formed in the periphery of the electron emission region 28 to emit electrons from the same. The emitted electrons then collide with the phosphor layers 34R, 34G, 34B of a corresponding pixel. The phosphor layers 34R, 34G, 34B are then excited to thereby display the desired images.

In the present invention, as shown in FIG. 2, the electron emission device further includes a grid electrode 40 so as to control a travel course of the emitted electrons. The grid electrode 40 is supported by spacers 38 at positions between the first and second substrates 20, 22. The grid electrode 40 acts to focus the electrons emitted from the electron emission region 28.

A plurality of electron passage openings 42 are formed with a plurality of bridge portions 44 on the grid electrode 40 in a predetermined pattern. As shown in FIG. 2, the electron emission openings 42 and the bridge portions 44 are alternatively positioned on the grid electrode 40.

The electron emission device according to the first through ninth exemplary embodiments of the present invention will now be described in detail with reference to FIG. 3 through FIG. 12. It should be noted that these exemplary embodiments use the basic configuration described above, so only differences in grid electrode structures will be explained in detail.

FIG. 3 through FIG. 6 are respectively partial exploded cross-sectional views of grid electrodes used in the electron emission device of FIGS. 1 and 2 according to first through fourth exemplary embodiments of the present invention, taken along line A-A of FIG. 1.

With reference to FIG. 3 through FIG. 6, the electron passage (or emission) openings 42 have at least one portion of the interior wall formed with an inclined plane relative to the first substrate 20. The electron passage opening 42 of the grid electrode 40 has a larger diameter portion S1 at the upper portion thereof facing the second substrate 22, and a smaller diameter portion S2 at the lower portion thereof facing the first substrate 20. The larger diameter portion (S1) has a larger diameter than that of the smaller diameter portion (S2).

Figure 3:
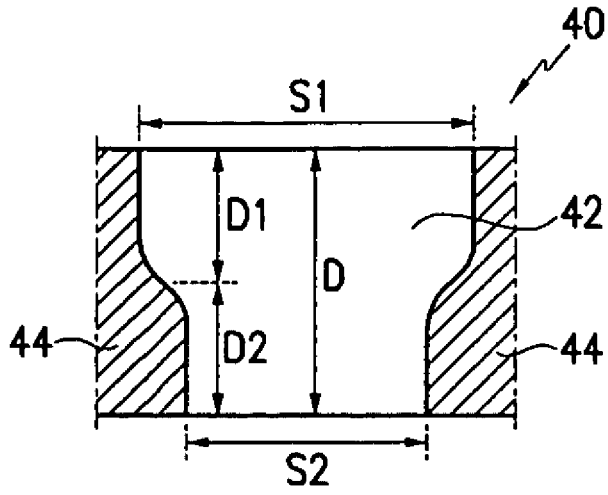
FIG. 3 is a partial exploded cross-sectional view of a grid electrode used in the electron emission device of FIG. 1 according to a first exemplary embodiment of the present invention, taken along line A-A of FIG. 1.

Particularly, in FIG. 3, the electron passage opening 42 has the larger diameter portion S1 extending through a depth D1 and downward from the upper portion (at a first end of the electron passage opening 42 facing the second substrate 22) thereof, and the smaller diameter portion S2 extending through a depth D2 and upward from the lower portion (at a second end of the electron passage opening 42 facing the first substrate 20) thereof. In this case, the depth D1 of the upper portion should be shorter than the distance D2 of the lower portion thereof. This is because the smaller diameter portion S2 is positioned toward the first substrate 20 (or electron emission region) from the center thereof so that the electron passage opening structured as above enables protection of the electrons from scattering on the interior wall thereof. More particularly, a ratio D2/D of the distance D2 to the overall height D of grid electrode 40 should be below 0.3.

Figure 4:
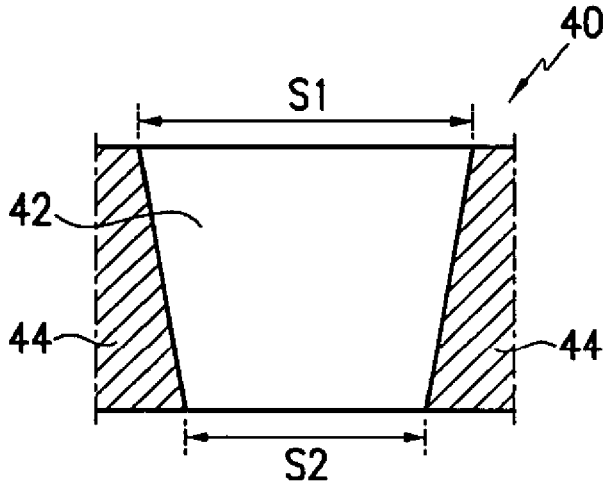
FIG. 4 is a partial exploded cross-sectional view of a grid electrode used in the electron emission device of FIG. 1 according to a second exemplary embodiment of the present invention, taken along line A-A of FIG. 1.
Figure 6:
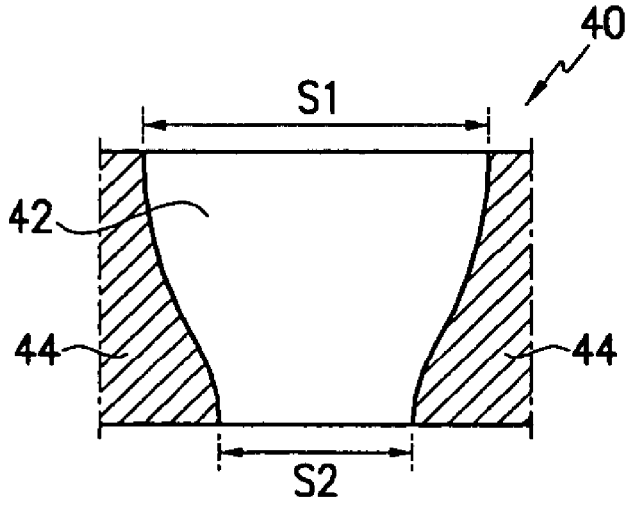
FIG. 6 is a partial exploded cross-sectional view of a grid electrode used in the electron emission device of FIG. 1 according to a fourth exemplary embodiment of the present invention, taken along line A-A of FIG. 1.

Further, in FIG. 3, FIG. 4, and FIG. 6, the electron passage opening 42 has an inclined plane of which the diameter increases gradually upward along the Z direction of FIG. 1. This inclined plane may be formed as a curved surface as shown in FIG. 6. In these cases, the larger diameter portion S1 is disposed at the upper portion of the electron passage opening 42 facing the second substrate 22.

Figure 5:
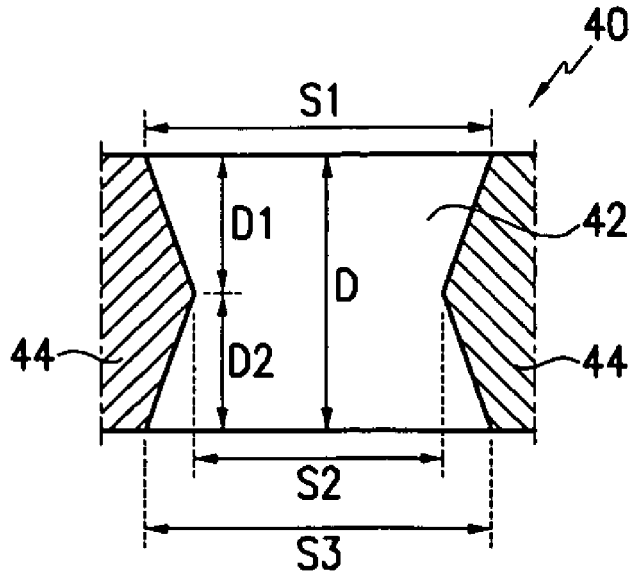
FIG. 5 is a partial exploded cross-sectional view of a grid electrode used in the electron emission device of FIG. 1 according to a third exemplary embodiment of the present invention, taken along line A-A of FIG. 1.

On the other hand, in the grid electrode 40 of FIG. 5, the electron passage opening 42 has inclined planes of which the diameter increases gradually in both ways, i.e., upward and downward from the center thereof. Accordingly, the smaller diameter portion S2 is positioned at the center of the electron passage opening 42. Also, a larger diameter portion S3 positioned at the lower portion of the electron passage opening 42 has a diameter that is smaller than a diameter of larger diameter portion S1 positioned at the upper portion and larger than a diameter of smaller diameter portion S2.

In operation and with the above-structured grid electrode, a part of the interior wall of the electron passage opening 42 on the travel path of electrons emitted from the electron emission region 28 is reduced. Therefore, electrons may not collide with the interior wall of the electron passage opening 42 and the travel path of the electrons may become more stable (i.e., not varied).

In the grid electrode 40 according to the first through fourth embodiments of the present invention, a ratio $\alpha$=S1/S2 of the smaller diameter portion S2 to the larger diameter portion S1 should be within about 1.0 to 2.0. This is because the electron passage opening structured as described above enables protection of the electrons from scattering while colliding on the interior wall thereof. That is, if the ratio $\alpha$ is below 1.0, the possibility that the electrons may collide on the interior wall of the electron passage opening 42 increases. Also, if the ratio $\alpha$ is above 2.0, it is difficult to manufacture the interior wall of the electron passage opening 42 (and/or it greatly weakens the grid electrode 40) and it is not efficient in that electrons excessively deviate from their travel course.

FIG. 7 through FIG. 11 are respectively partial exploded cross-sectional views of grid electrodes used for electron emission devices according to fifth through ninth exemplary embodiments of the present invention taken along line B-B of FIG. 1.

Figure 7:
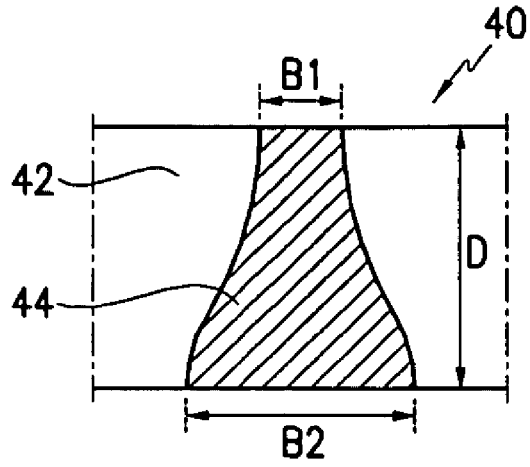
FIG. 7 is a partial exploded cross-sectional view of a grid electrode used in the electron emission device of FIG. 1 according to a fifth exemplary embodiment of the present invention taken along line B-B of FIG. 1.
Figure 8:
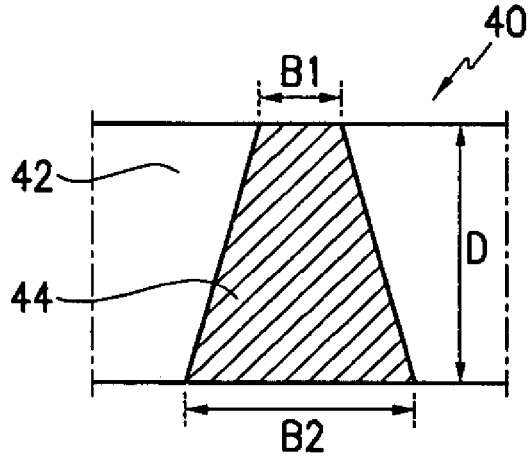
FIG. 8 is a partial exploded cross-sectional view of a grid electrode used in the electron emission device of FIG. 1 according to a sixth exemplary embodiment of the present invention, taken along line B-B of FIG. 1.

In FIG. 7 and FIG. 8, a bridge portion 44 of a grid electrode 40 has a larger width portion B2 at the lower portion thereof (at the second end facing the first substrate 20) and a smaller width portion B1 at the upper portion thereof (at the first end facing the second substrate 20). The larger width portion B2 has a larger width than that of the smaller width portion B1 in the cross section of the grid electrode 40 taken along line B-B of FIG. 1. The bridge portion 44 has an inclined plane of which the width gradually reduces upward along the Z direction of FIG. 1. This inclined plane may be formed as a curved surface as shown in FIG. 7. In these cases, a ratio β=B1/B2 of width of the smaller width portion B1 positioned at the upper portion of the bridge portion to that of the larger width portion B2 positioned at the lower portion of the bridge portion should be within about 0.2 to 0.5. This is because if the ratio β is above 0.5, the interior wall of the electron passage opening 42 to which the electrons may collide has not been sufficiently removed (i.e., the wall is too thick), and if the ratio β is below 0.2, the strength of the bridge portion 44 is not sufficient. Accordingly, the ratio of the minimum bridge width B1 of the bridge portion 44 to the height thereof should be above about 0.2 such that the bridge portion 44 has sufficient strength. Moreover, a ratio B1/D of the smaller width portion B1 to the overall height or depth D of the electron passage opening 42 should be above about 0.2.

Figure 9:
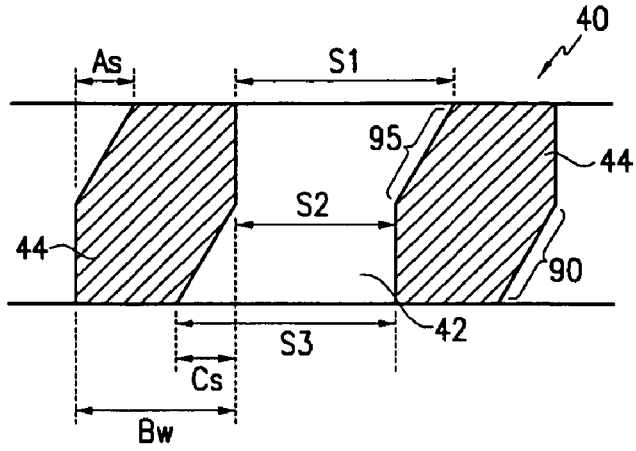
FIG. 9 is a partial exploded cross-sectional view of a grid electrode used in the electron emission device of FIG. 1 according to a seventh exemplary embodiment of the present invention, taken along line B-B of FIG. 1.

Referring now to FIG. 9, in the cross section taken along line B-B of FIG. 1, the bridge portion 44 in the seventh exemplary embodiment of the present invention has an inclined plane 90 at a part (a lower portion thereof) of one side surface (the right side surface of FIG. 9) thereof. Also, the bridge portion 44 has an inclined plane 95 at a part (an upper portion thereof apart from the electron emission region 28) of the other side surface (the left side surface of FIG. 9) thereof. In this case, the inclined plane 95 formed at the upper portion has the same slope as that of the inclined plane 90 formed at the lower portion. Here, the slope is referred to as an absolute value of a slope to a normal line extending vertically to the second substrate 22.

Figure 10:
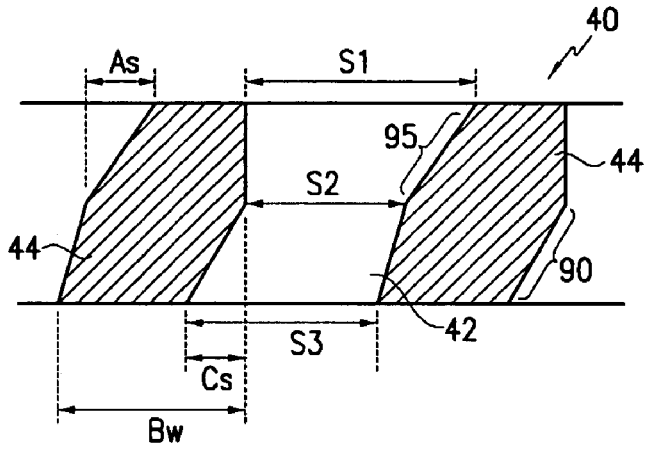
FIG. 10 is a partial exploded cross-sectional view of a grid electrode used in the electron emission device of FIG. 1 according to an eighth exemplary embodiment of the present invention, taken along line B-B of FIG. 1.

Referring to FIG. 10, in the cross section taken along line B-B of FIG. 1, the bridge portion 44 in the eighth exemplary embodiment of the present invention has an inclined plane on both side surfaces thereof. The inclined planes have two or more changes of slope along the depth direction. In more detail, the inclined plane formed at one side surface has a smaller slope at the upper portion than that at the lower portion thereof, while the inclined plane formed at the other side surface has a larger slope at the upper portion than that at the lower portion thereof (i.e., As is greater than Cs). As a result of the above-structured bridge portion 44, the diameter of the electron passage openings 42 increases both ways from the center along the Z direction of FIG. 1. In this case, the smaller diameter portion S2 is positioned at the center of the electron passage opening 42, and the larger diameter portion S3 positioned at the lower portion of the electron passage opening 42 may have a diameter that is smaller than the larger diameter portion S1 positioned at the upper portion and larger than that of the smaller diameter portion S2.

Figure 11:
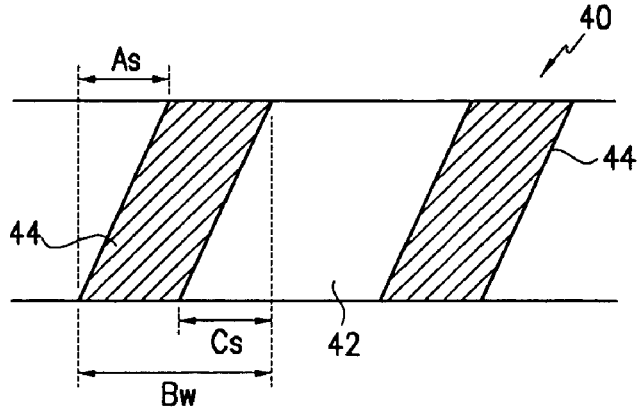
FIG. 11 is a partial exploded cross-sectional view of a grid electrode used in the electron emission device according to a ninth exemplary embodiment of the present invention, taken along line B-B of FIG. 1.

With reference to FIG. 11, in the cross section taken along line B-B of FIG. 1, the bridge portion 44 in the ninth exemplary embodiment of the present invention has an inclined plane formed over the entirety of both side surfaces thereof, and the inclined planes have the same slope.

In the seventh through ninth exemplary embodiments shown in FIG. 9 through FIG. 11, a ratio (As/Bw, Cs/Bw) of the horizontal distance As of the inclined plane formed at the one side surface of the bridge portion 44 and/or the horizontal distance Cs of the inclined plane formed at the other side surface thereof over the total width Bw should be within about 0.3 to 0.7. Herein, the total width is referred to as a width of a rectangle snuggly surrounding one bridge portion with the inclined structure, and the horizontal distance is referred to as a horizontal width of a portion subtracted therefrom in order to form the inclined plane from the rectangle.

The ratio (As/Bw, Cs/Bw) should be within about 0.3 to 0.7 because if the ratio of the horizontal distance As, Cs of the inclined plane to the total width Bw of the bridge portion 44 is below 0.3, the bridge portion 44 is too thick (i.e., the interior wall of the electron passage opening 42 with which the electrons may collide has not been sufficiently removed, and if the ratio of horizontal distance As, Cs of the inclined plane to the total width Bw of the bridge portion 44 is above 0.7, the strength of the bridge portion 44 is not sufficient.

Also, a ratio (As/Cs) of the horizontal distance As of the inclined plane formed at one side surface of the bridge portion 44 to the horizontal distance Cs of the inclined plane formed at the other side surface thereof should be within about 0.5 to 1.5. That is, both sides of the bridge portion 44 should be formed while satisfying the values of $0.5 \leqq As/Cs \leqq 1.5$.

Figure 12A:
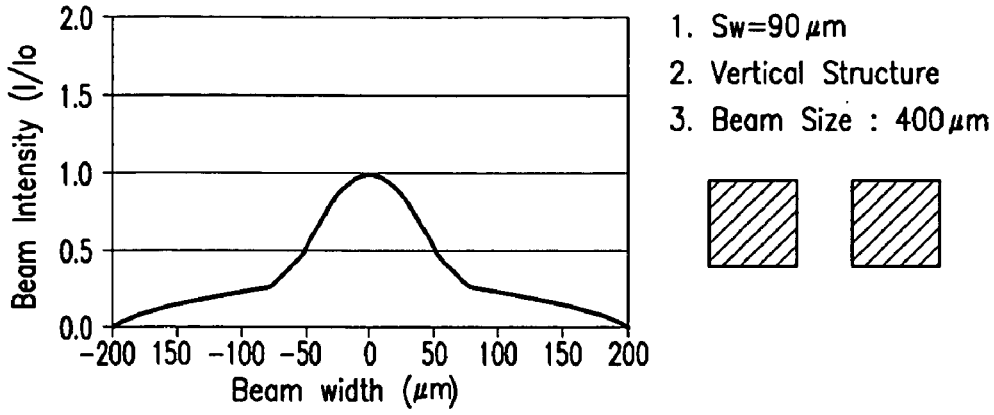
FIG. 12A through FIG. 12C are graphs showing the intensity of an electron beam in cases that both side lines of the electron passage opening have 90° slopes, positive slopes, and negative slopes.
Figure 12B:
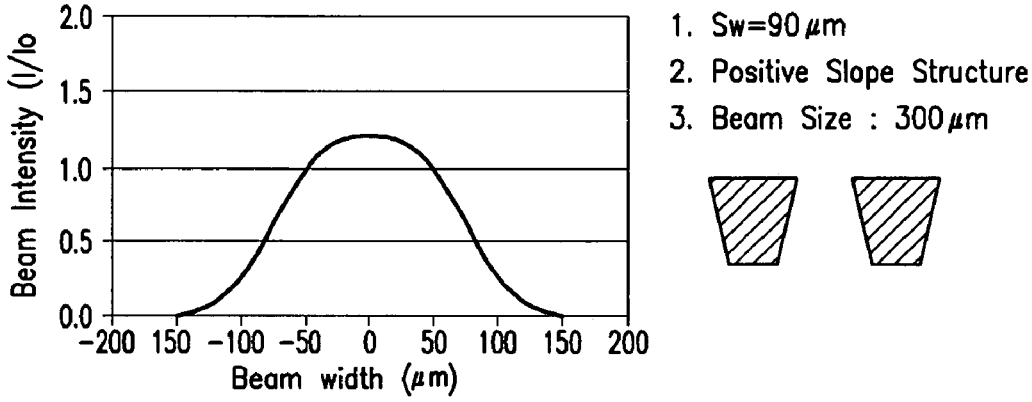
Figure 12C:
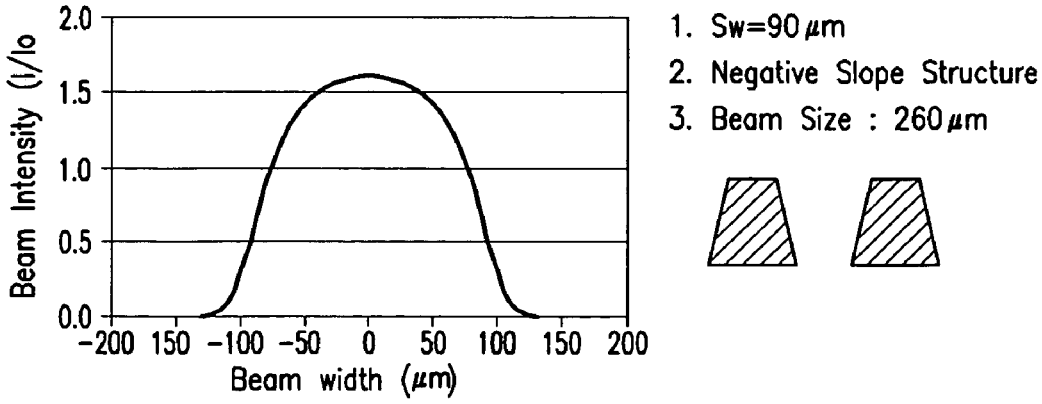

In an electron emission device according to certain embodiments of the present invention, FIG. 12A through FIG. 12C are graphs showing the intensity of an electron beam in cases that both side lines of the electron passage opening have 90° slopes (i.e., a vertical structure), positive slopes (i.e., a positive slope structure), and negative slopes (i.e., a negative slope structure). Herein, the positive slope is referred to as the size of the upper portion becomes gradually larger than that of the lower portion.

In the case that both side lines of the electron passage opening have 90° slopes (see FIG. 12A), the size or profile of the electron beam through the passage opening is at about 400 μm. By contrast, the size or profile of the structure with the positive slope is about 300 μm (see FIG. 12B) and the structure with the negative slope is about 260 μm. On the other hand, the intensity (I/Io) of the embodiments of FIGS. 12B and 12C are above 1.0 while the entity of the embodiment of FIG. 12A is at 1.0. This is because the electron beam emitted from the electron emission region 28 in certain embodiments of the present invention is focused in the electron passage opening 42 of the grid electrode 40 having electron passage opening 42 of a slope structure, and emitted electrons are reduced, some of which collide on the interior wall of the electron passage opening 42 such that the travel course of the electrons varies. As a result, other (or non-relevant) color illumination may be reduced and/or color purity may be enhanced.

In general and in view of the foregoing, an operating process of an electron emission device according to an embodiment of the present invention will now be described with reference to FIG. 1.

First, a predetermined voltage from external electrical power is applied to the gate electrode(s) 24, the cathode electrode(s) 26, the grid electrode 40, and the anode electrode(s) 32. At this time, for instance, (+) voltage may be applied to the gate electrode(s) 24 and the cathode electrode (s) 26, and/or alternating (+) or (−) voltage may be applied to the gate electrode(s) 24 and the cathode electrode(s) 26. The voltage level of the gate electrode(s) 24 should be larger than that of the cathode electrode(s) 26, and the voltage level of the gate electrode(s) 24 should be smaller than that of the anode electrode(s) 32. The voltage level of the grid electrode 40 should be set between that of the anode electrode(s) 32 and the gate electrode(s) 24. Also, the same direct current voltage source or alternative current voltage source applied to the anode electrode 32 may be applied to the grid electrode 40.

When each of the above voltages is applied to the corresponding electrode, the voltage difference occurring between the gate electrode 24 and cathode electrode 26 enable the electric field at the periphery of the electron emission region 28 to be produced. At this time, through the influence of the electric field, electrons are emitted from the edge of the electron emission region 28, and the resulting emitted electrons are focused by the electron passage opening or openings 42, each with a slope structure, formed at the grid electrode 40 and the voltage applied to the grid electrode 40. These electrons are continuously guided to the corresponding pixels by the high voltage applied to the one or more anode electrodes to strike the phosphor layers 34R, 34G, 34B corresponding to the pixels, thereby illuminating them.

The grid electrode according to the present invention may be applied to field emission array (FEA) electron emission display devices, surface conduction emitter (SCE) electron emission display devices, or other variable electron emission display devices.

In view of the foregoing, a grid electrode with a sloped electron passage opening of the present invention prevents the travel course of electrons from being varied, so illumination of the wrong pixels is prevented and/or reduced and overall color purity is improved.

Also, according to certain embodiments of the present invention, the number of electrons colliding on an illumination portion is increased, to enhance the brightness and the screen quality.

Further, according to certain embodiments of the present invention, the electrons are prevented from scattering while colliding on the interior wall of the electron passage openings so that the focusing degree of the electron beam can be increased.

While this invention has been described in connection with certain exemplary embodiment(s), it is to be understood that the invention is not limited to the disclosed embodiment(s), but, on the contrary, is intended to cover various modifications included within the spirit and scope of the appended claims and equivalents thereof.

What is claimed is:

1. An electron emission device comprising:

a first substrate and a second substrate facing one another and having a predetermined gap therebetween;

an electron emission region, for emitting electrons, on the first substrate;

an illumination portion, for displaying images responsive to the electrons emitted from the electron emission region, on the second substrate; and a grid electrode mounted between the first and second substrates and configured to focus the electrons emitted from the electron emission region toward the illumination portion, wherein the grid electrode is provided with a plurality of electron passage openings, at least one of the electron passage openings having an interior wall, the interior wall having at least one portion formed with an inclined plane relative to the first substrate, wherein the at least one of the electron passage openings is provided with a larger diameter portion and a smaller diameter portion, wherein the larger diameter portion has a diameter larger than a diameter of the smaller diameter portion, wherein the larger diameter portion is formed at an upper portion of the at least one of the electron passage openings toward the second substrate, wherein the larger diameter portion has a first depth, wherein the smaller diameter portion is extended continuously from the larger diameter portion and has a second depth, and wherein the first depth is shorter than the second depth.

2. The electron emission device of claim 1, wherein the electron emission region comprises a carbon-based material selected from the group consisting of a carbon nanotube material, a graphite material, a diamond material, a diamond-like carbon material, a C60 (Fullerene) material, and a combination thereof.

3. The electron emission device of claim 1, wherein the larger diameter portion and another larger diameter portion are respectively formed at the upper portion and a lower portion of the at least one of the electron passage openings, the diameter of the larger diameter portion is reduced gradually from the upper portion to the lower portion, and the diameter of the another larger diameter portion is increased gradually from the lower portion to the upper portion so that the smaller diameter protion is formed at the center of the at least one of the electron passage openings.

4. The electron emission device of claim 1, wherein a ratio of the diameter of the large diameter portion to that of the diameter of the small diameter portion is within about 1 to 2.

5. The electron emission device of claim 1, wherein a ratio of the second depth of the smaller diameter portion to a total depth of the at least one of the electron passage openings is below about 0.3.

6. The electron emission device of claim 1, wherein the grid electrode has bridge portions interconnecting the electron passage openings, and each of the bridge portions has a smaller width portion at an upper portion of the electron passage openings toward the second substrate and a larger width portion at a lower portion of the electron passage openings toward the first substrate.

7. The electron emission device of claim 6, wherein at least one of the bridge portions has a plurality of inclined planes tapered entirely upward toward the second substrate.

8. The electron emission device of claim 6, wherein at least one of the bridge portions has a plurality of inclined planes with identical slopes.

9. The electron emission device of claim 6, wherein at least one of the bridge portions has a plurality of inclined planes having at least two slope changes along a depth direction of the at least one of the bridge portions.

10. The electron emission device of claim 9, wherein the inclined plane formed at one side surface of the at least one of the bridge portions has a larger slope at the upper portion than that at the lower portion.

11. An electron emission device comprising:

a first substrate and a second substrate facing one another and having a predetermined gap therebetween;

an electron emission region for emitting electrons formed on the first substrate;

an illumination portion for displaying images responsive to the electrons emitted from the electron emission region formed on the second substrate; and a grid electrode mounted between the first and second substrates and configured to focus the electrons emitted from the electron emission region toward the illumination portion, wherein the grid electrode is provided with a plurality of electron passage openings, at least one of the electron passage openings having an interior wall, the interior wall having at least one portion formed with an inclined plane relative to the first substrate, wherein the at least one of the electron passage openings has a cross section taken longitudinally along a diameter of the at least one of the electron passage openings, the cross section forming an inclined plane tapered downward toward the first substrate, and wherein the inclined plane is formed as a curved plane.

12. An electron emission device comprising:

a first substrate and a second substrate facing one another and having a predetermined gap therebetween;

an electron emission region, for emitting electrons, on the first substrate;

an illumination portion, for displaying images responsive to the electrons emitted from the electron emission region, on the second substrate; and a grid electrode mounted between the first and second substrates and configured to focus the electrons emitted from the electron emission region toward the illumination portion, wherein the grid electrode is provided with a plurality of electron passage openings, at least one of the electron passage openings having an interior wall, the interior wall having at least one portion formed with an inclined plane relative to the first substrate, wherein the grid electrode has bridge portions interconnecting the electron passage openings, and each of the bridge portions has a smaller width portion at an upper portion of the electron passage openings toward the second substrate and a larger width portion at a lower portion of the electron passage openings toward the first substrate, and wherein a ratio of the smaller width portion to the larger width portion is within about 0.2 to 0.5.

13. An electron emission device comprising:

a first substrate and a second substrate facing one another and having a predetermined gap therebetween;

an electron emission region, for emitting electrons, on the first substrate;

an illumination portion, for displaying images responsive to the electrons emitted from the electron emission region, on the second substrate; and a grid electrode mounted between the first and second substrates and configured to focus the electrons emitted from the electron emission region toward the illumination portion, wherein the grid electrode is provided with a plurality of electron passage openings, at least one of the electron passage openings having an interior wall, the interior wall having at least one portion formed with an inclined plane relative to the first substrate, wherein the grid electrode has bridge portions interconnecting the electron passage openings, and each of the bridge portions has a smaller width portion at an upper portion of the electron passage openings toward the second substrate and a larger width portion at a lower portion of the electron passage openings toward the first substrate, and wherein a ratio of the smaller width portion to a total depth of the at least one of the electron passage openings is above about 0.2.

14. The electron emission device of claim 13, wherein a ratio, As/Cs, of a first horizontal element, As, of at least one of the bridge portions to a second horizontal element, Cs, of the at least one of the bridge portions is within about 0.5 to 1.5.

15. An electron emission device comprising:

a first substrate and a second substrate facing one another and having a predetermined gap therebetween;

an electron emission region, for emitting electrons, on the first substrate;

an illumination portion, for displaying images responsive to the electrons emitted from the electron emission region, on the second substrate; and a grid electrode mounted between the first and second substrates and configured to focus the electrons emitted from the electron emission region toward the illumination portion, wherein the grid electrode is provided with a plurality of electron passage openings, at least one of the electron passage openings having an interior wall, the interior wall having at least one portion formed with an inclined plane relative to the first substrate, wherein the grid electrode has bridge portions interconnecting the electron passage openings, and each of the bridge portions has a smaller width portion at an upper portion of the electron passage openings toward the second substrate and a larger width portion at a lower portion of the electron passage openings toward the first substrate, wherein at least one of the bridge portions has a plurality of inclined planes having at least two slope changes along a depth direction of the at least one of the bridge portions, and wherein the inclined plane formed at one side surface of the at least one of the bridge portions has a smaller slope at the upper portion than that at the lower portion.

16. An electron emission device comprising:

a first substrate and a second substrate facing one another and having a predetermined gap therebetween;

an electron emission region, for emitting electrons, on the first substrate;

an illumination portion, for displaying images responsive to the electrons emitted from the electron emission region, on the second substrate; and a grid electrode mounted between the first and second substrates and configured to focus the electrons emitted from the electron emission region toward the illumination portion, wherein the grid electrode is provided with a plurality of electron passage openings, at least one of the electron passage openings having an interior wall, the interior wall having at least one portion formed with an inclined plane relative to the first substrate, wherein the grid electrode has bridge portions interconnecting the electron passage openings, and each of the bridge portions has a smaller width portion at an upper portion of the electron passage openings toward the second substrate and a larger width portion at a lower portion of the electron passage openings toward the first substrate, wherein at least one of the bridge portions has a plurality of inclined planes having at least two slope changes along a depth direction of the at least one of the bridge portions, and wherein a first ratio, As/Bw, of a first horizontal element, As, of one of the inclined planes formed at one side of the at least one of the bridge portions to a total width, Bw, of the at least one of the bridge portions and a second ratio, Cs/Bw, of a second horizontal element, Cs, of another one of the inclined planes formed at another side of the at least one of the bridge portions to the total width, Bw, of the at least one of the bridge portions are each respectively within about 0.3 to 0.7.

* * * * *

UNITED STATES PATENT AND TRADEMARK OFFICE

CERTIFICATE OF CORRECTION

PATENT NO. : 7,256,540 B2
APPLICATION NO. : 10/999106
DATED : August 14, 2007
INVENTOR(S) : Sang-Ho Jeon et al.

It is certified that error appears in the above-identified patent and that said Letters Patent is hereby corrected as shown below:

In the Claims

Column 10, line 23, Claim 3 — Delete "protion", Insert --portion--

Signed and Sealed this

Nineteenth Day of August, 2008

JON W. DUDAS
*Director of the United States Patent and Trademark Office*